US008231408B2

(12) United States Patent
Ebihara

(10) Patent No.: US 8,231,408 B2
(45) Date of Patent: Jul. 31, 2012

(54) CONNECTOR

(75) Inventor: Hiroyuki Ebihara, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/955,324

(22) Filed: Nov. 29, 2010

(65) Prior Publication Data

US 2011/0130035 A1 Jun. 2, 2011

(30) Foreign Application Priority Data

Nov. 30, 2009 (JP) ..... 2009-272213

(51) Int. Cl.
*H01R 13/52* (2006.01)

(52) U.S. Cl. ..... 439/587

(58) Field of Classification Search ..... 439/275, 439/587, 589, 281, 320, 354, 681, 686
See application file for complete search history.

(56) References Cited

U.S. PATENT DOCUMENTS

| | | | | |
|---|---|---|---|---|
| 6,913,486 | B2 * | 7/2005 | Nagayasu et al. | 439/587 |
| 2007/0212936 | A1 * | 9/2007 | Eckel et al. | 439/578 |
| 2009/0017685 | A1 * | 1/2009 | Eckel et al. | 439/610 |

FOREIGN PATENT DOCUMENTS

JP 2008-171636 A 7/2008

* cited by examiner

*Primary Examiner* — Alexander Gilman
(74) *Attorney, Agent, or Firm* — Holtz, Holtz, Goodman & Chick, PC

(57) ABSTRACT

A connector that has a high waterproof property, and can be easily assembled. A housing is formed with a through hole for accommodating a contact which is connected to a cable. An elastic sealing member that has a hollow cylindrical shape and is fitted on an outer peripheral surface of the cable is accommodated in a rear portion of the through hole, and an urging member having a hollow cylindrical shape is fitted on an outer peripheral surface of the housing. The urging member is formed with a tapered surface for urging a rear end of the elastic sealing member against the outer peripheral surface of the cable when the urging member is fitted on the outer peripheral surface of the housing.

20 Claims, 15 Drawing Sheets

CONNECTOR

BACKGROUND OF THE INVENTION

1. Field of the Invention

This invention relates to a connector.

2. Description of the Related Art

Conventionally, there has been proposed a waterproof connector comprising terminals, an insulating housing, a holder, and a waterproof plug (see Japanese Laid-Open Patent Publication (Kokai) No. 2008-171636 (Paragraphs [0022] to [0030], and FIG. 8)).

Each of the terminals is made of metal, and is connected to an electric wire.

The insulating housing has a plurality of terminal-accommodating chambers, a plurality of terminal-holding portions, and an accommodating wall. Each of the terminal-accommodating chambers accommodates an associated one of the terminals. Each of the terminal-holding portions is provided in an associated one of the terminal-accommodating chambers, and holds the terminal accommodated in the associated terminal chamber. The accommodating wall accommodates the waterproof plug and the holder.

The holder is fixed to the insulating housing in a removable manner. When the holder is fixed to the insulating housing, the holder urges the waterproof plug against the insulating housing.

The waterproof plug is made of an elastic material, and has a substantially hollow cylindrical shape. The waterproof plug has first wire insertion holes each of which is formed with a plurality of protrusions on an inner peripheral surface thereof. The protrusions each extend in a circumferential direction of the inner peripheral surface of the waterproof plug, and are brought into close contact with an outer peripheral surface of the electric wire.

To assemble this waterproof connector, first, the waterproof plug is received into the accommodating wall of the insulating housing.

Next, the holder is received into the accommodating wall of the insulating housing, thereby being fitted in the insulating housing.

Finally, each terminal connected to the electric wire is inserted through the associated first wire insertion hole of the waterproof plug, and is then inserted into the associated terminal accommodating chamber of the insulating housing. At this time, each electric wire passes through the associated first wire insertion hole of the waterproof plug.

For improvement in the waterproof property of the above-described waterproof connector, it is only required to increase the number of protrusions provided on the inner peripheral surface of each first wire insertion hole of the waterproof plug. However, if the number of the protrusions is increased, this makes it difficult to insert the wires or the like through the respective first wire insertion holes of the waterproof plug when the connector is assembled.

SUMMARY OF THE INVENTION

The present invention has been made in view of these circumstances, and an object thereof is to provide a connector which has a high waterproof property, and can be easily assembled.

To attain the above object, in a first aspect of the present invention, there is provided a connector comprising a contact that is connected to a cable, a housing that has a through hole for accommodating the contact that is connected to the cable, an elastic sealing member that has a hollow cylindrical shape, the elastic sealing member being fitted on an outer peripheral surface of the cable and being accommodated in a rear portion of the through hole, and an urging member that has a hollow cylindrical shape and is fitted on an outer peripheral surface of the housing, the urging member urging the elastic sealing member in an axial direction when the urging member is fitted on the outer peripheral surface of the housing, and including an urging portion for urging a rear end of the elastic sealing member against the outer peripheral surface of the cable.

With the arrangement of the connector according to the first aspect of the present invention, when the urging member is fitted on the outer peripheral surface of the housing, the rear end of the elastic sealing member is urged against the outer peripheral surface of the cable by the urging portion of the urging member, and hence the rear end of the elastic sealing member is brought into close contact with the outer peripheral surface of the cable, whereby the waterproof property is ensured.

On the other hand, when the urging member is not fitted on the outer peripheral surface of the housing, the elastic sealing member is not urged by the urging portion of the urging member, and hence the elastic member is not compressed, which makes it possible to easily insert the cable through the elastic sealing member.

To attain the above object, in a second aspect of the present invention, there is provided a connector comprising a contact that is connected to a cable, a housing that has a through hole for accommodating the contact that is connected to the cable, an elastic sealing member that has a hollow cylindrical shape, the elastic sealing member being fitted on an outer peripheral surface of the cable and being accommodated in a rear portion of the through hole, an urging member that has a hollow cylindrical shape and is fitted on an outer peripheral surface of the housing, and a clamp member that has a hollow cylindrical shape, and is fitted on the outer peripheral surface of the cable, the clamp member being accommodated in the urging member, the clamp member being disposed rearward of the elastic sealing member, and when the urging member is fitted on the outer peripheral surface of the housing, the clamp member being urged by the urging member to urge the elastic sealing member in the axial direction, the clamp member including an urging portion for urging a rear end of the elastic sealing member against the outer peripheral surface of the cable.

With the arrangement of the connector according to the second aspect of the present invention, when the urging member is fitted on the outer peripheral surface of the housing, the clamp member is urged by the urging member, whereby the rear end of the elastic sealing member is urged against the outer peripheral surface of the cable by the urging portion of the clamp member. This brings the rear end of the elastic sealing member into close contact with the outer peripheral surface of the cable, whereby the waterproof property is ensured.

On the other hand, when the urging member is not fitted on the outer peripheral surface of the housing, the elastic sealing member is not urged by the urging portion of the clamp member, and hence the elastic sealing member is not compressed, which makes it possible to easily insert the cable through the elastic sealing member.

In the second aspect of the invention, preferably, the clamp member includes a plurality of flexible portions which are located rearward of the urging portion in the axial direction, and are urged against the outer peripheral surface of the cable when the urging member is fitted on the outer peripheral surface of the housing.

In each aspect of the invention, preferably, when the urging member is fitted on the outer peripheral surface of the housing, the urging portion urges the elastic sealing member against an inner peripheral surface of the housing to thereby compress the elastic sealing member in the axial direction.

In each aspect of the invention, preferably, the connector comprises an outer protruding portion that is formed on an outer peripheral surface of the elastic sealing member such that the outer protruding portion extends along a circumferential direction, and is brought into contact with an inner peripheral surface of the rear portion of the through hole, and an inner protruding portion that is formed on an inner peripheral surface of the elastic sealing member such that the inner protruding portion extends along the circumferential direction, and is brought into contact with the outer peripheral surface of the cable.

In each aspect of the invention, more preferably, the elastic sealing member has a groove formed in the outer peripheral surface thereof such that the groove extends along the circumferential direction, and the groove and the inner protruding portion are substantially at a same location in the axial direction of the elastic sealing member.

In each aspect of the invention, further preferably, the rear portion of the through hole includes a small inner-diameter portion, and a large inner-diameter portion which is located rearward of the small inner-diameter portion and has an inner diameter larger than an inner diameter of the small inner-diameter portion, and the elastic sealing member includes a small outer-diameter portion which is accommodated in the small inner-diameter portion, and a large outer-diameter portion which is located rearward of the small outer-diameter portion, and is accommodated in the large inner-diameter portion, the large outer-diameter portion having an outer diameter larger than an outer diameter of the small outer-diameter portion, wherein the outer protruding portion is located on an outer peripheral surface of the small outer-diameter portion, the inner protruding portion comprising protruding portions located on an inner peripheral surface of the small outer-diameter portion and an inner peripheral surface of the large outer-diameter portion, respectively, the groove being located in the outer peripheral surface of the large outer-diameter portion.

Preferably, in each aspect of the invention, the urging member has holes formed therein, and the housing has protrusions formed on an outer peripheral surface of a rear end thereof, the protrusions being fitted in the holes, respectively, when the urging member is fitted on the outer peripheral surface of the housing.

According to this invention, it is possible to provide the connector which has a high waterproof property, and can be easily assembled.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

First, a description will be given of a first embodiment of the present invention with reference to FIGS. 1 to 7.

Figure 1:
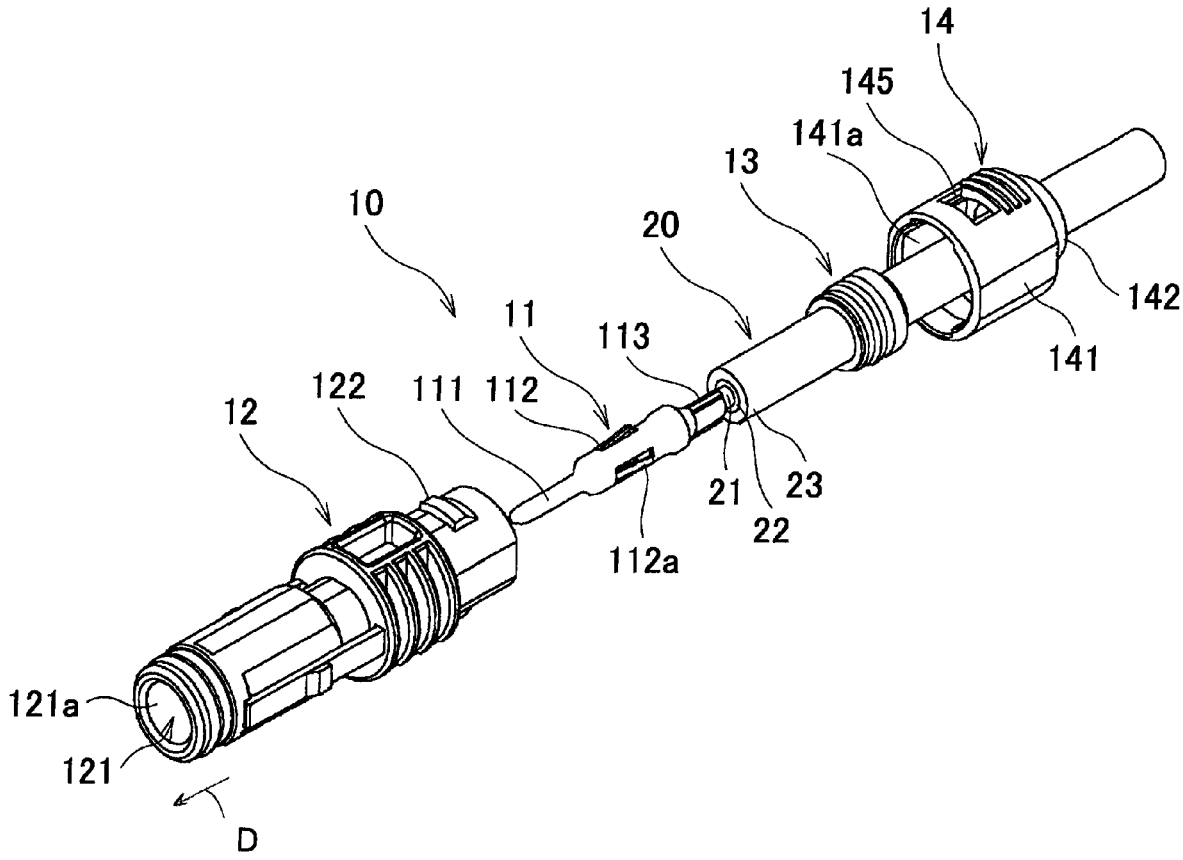
FIG. 1 is an exploded perspective view of a connector according to a first embodiment of the present invention.

Referring to FIG. 1, a connector 10 comprises a contact 11, a housing 12, an elastic sealing member 13, and an urging member 14.

The contact 11 includes a contact portion 111, a holding portion 112, and a connection portion 113. The contact portion 111 is brought into contact with a contact portion of a mating contact of a mating connector, not shown. The holding portion 112 is continuous with the contact portion 111. The holding portion 112 includes a pair of lances 112*a*. The holding portion 112 is held in the housing 12 by the pair of lances 112*a*. The connection portion 113 is connected to a cable 20. The connection portion 113 is a type crimped onto the cable 20 when connected thereto. The cable 20 is formed by a conductor 21, a covering 22 which covers the conductor 21, and a sheath 23 which covers the covering 22.

Figure 2:
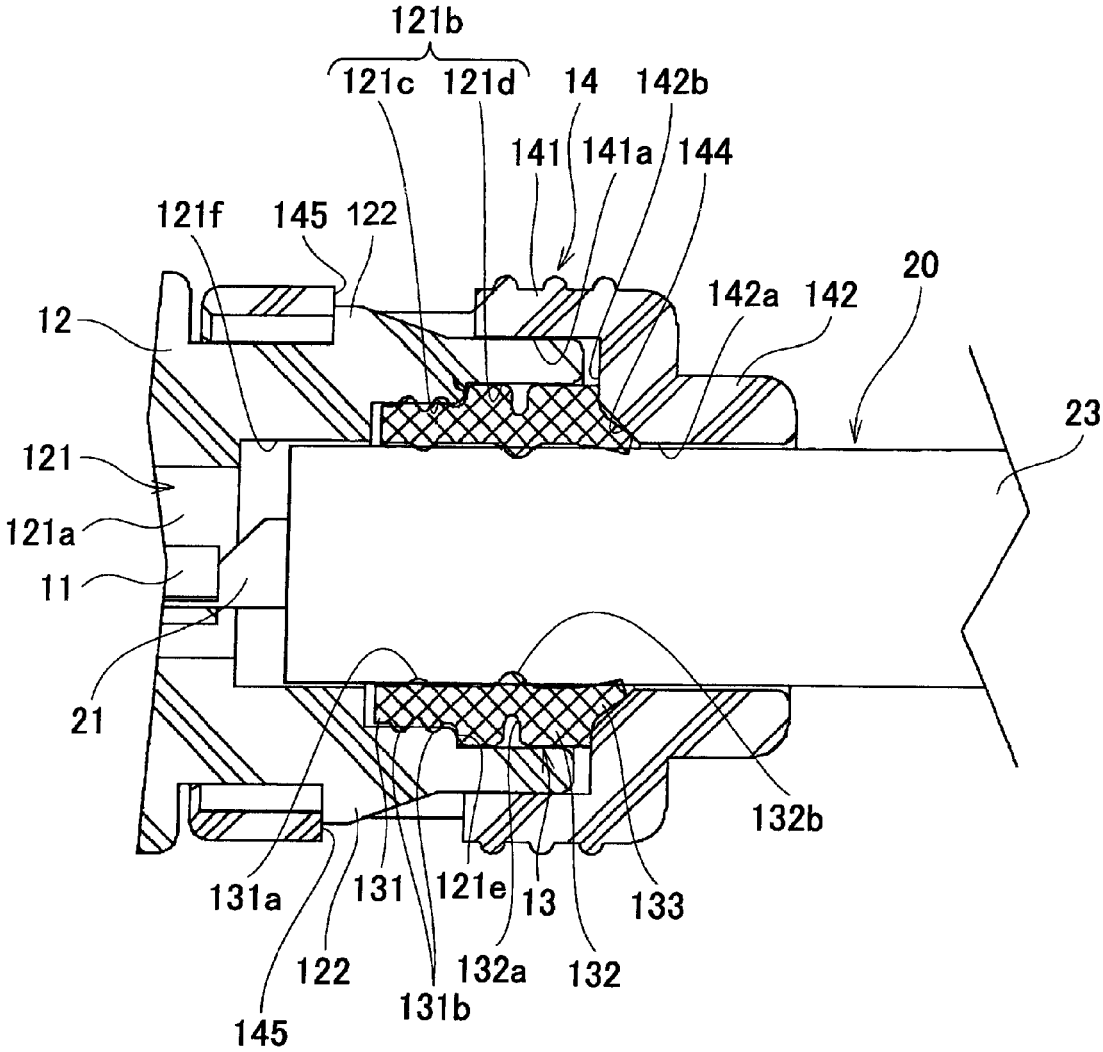
FIG. 2 is a cross-sectional view of a rear portion of the connector shown in FIG. 1.

Referring to FIG. 2, the housing 12 has a substantially hollow cylindrical shape, and has a through hole 121. The housing 12 is made of a resin. Most part of the through hole 121 forms a contact-accommodating portion 121*a*. The contact-accommodating portion 121*a* accommodates the contact 11. A rear portion of the through hole 121 forms an elastic sealing member-accommodating portion 121*b*. The elastic sealing member-accommodating portion 121*b* accommodates the elastic sealing member 13. The elastic sealing member-accommodating portion 121*b* includes a small inner-diameter portion 121*c* and a large inner-diameter portion 121*d*. The large inner-diameter portion 121*d* has a diameter larger than that of the small inner-diameter portion 121*c*. A step surface 121*e* (inner peripheral surface of the housing) is formed between the small inner-diameter portion 121*c* and the large inner-diameter portion 121*d*.

A rear portion of the housing 12 (rear portion in a direction D of fitting the connector 10, as viewed in FIG. 1) is formed with a pair of locking lugs (protrusions) 122 on an outer peripheral surface thereof.

Figure 3:
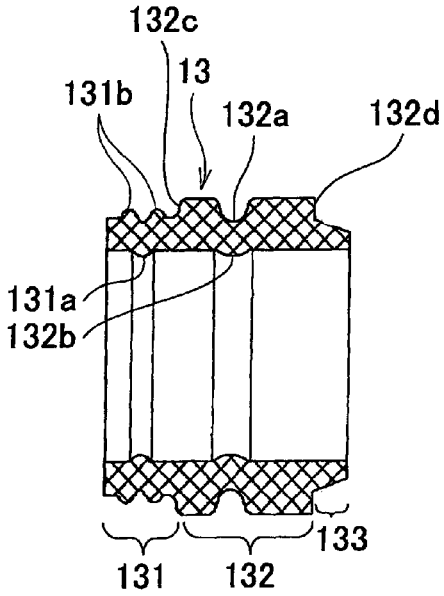
FIG. 3 is a cross-sectional view of an elastic sealing member of the connector shown in FIG. 1.

Referring to FIG. 3, the elastic sealing member 13 has a substantially hollow cylindrical shape, and includes a small outer-diameter portion 131, a large outer-diameter portion 132, and a sealing portion 133. The elastic sealing member 13 is fitted on an outer peripheral surface of the cable 20. The elastic sealing member 13 is made of rubber. The elastic sealing member 13 has an inner diameter slightly larger than the outer diameter of the cable 20, except for inner protruding portions 131*a* and 132*b*, referred to hereinafter.

The small outer-diameter portion 131 is disposed in the small inner-diameter portion 121*c* of the elastic sealing member-accommodating portion 121*b* of the housing 12. The small outer-diameter portion 131 is formed with the inner protruding portion 131*a* on an inner peripheral surface thereof such that the inner protruding portion 131*a* extends along the circumferential direction. The inner diameter of the inner protruding portion 131*a* is slightly smaller than the outer diameter of the cable 20, whereby the inner protruding portion 131*a* is brought into contact with the outer peripheral surface of the cable 20. The small outer-diameter portion 131 is formed with outer protruding portions 131*b* on an outer peripheral surface thereof such that the outer protruding portions 131*b* extend along the circumferential direction. The outer diameter of each outer protruding portion 131*b* is slightly larger than the diameter of the small inner-diameter portion 121*c* of the elastic sealing member-accommodating portion 121*b*, whereby the outer protruding portions 131*b* are brought into contact with an inner peripheral surface of the through hole 121 of the housing 12.

The large outer-diameter portion 132 is continuous with a rear end of the small outer-diameter portion 131 (rear end in the direction D of fitting the connector 10). The large outer-diameter portion 132 is formed with a groove 132*a* in an outer peripheral surface thereof such that the groove extends along the circumferential direction. The large outer-diameter portion 132 is formed with the inner protruding portion 132*b* on an inner peripheral surface thereof such that the inner protruding portion 132*b* extends along the circumferential direction. The groove 132*a* and the inner protruding portion 132*b* are at substantially the same location in a direction along the central axis of the elastic sealing member 13 (direction in which the elastic sealing member 13 is received into the housing 12). The inner diameter of the inner protruding portion 132*b* is slightly smaller than the outer diameter of the cable 20, whereby the inner protruding portion 132*b* is brought into contact with the outer peripheral surface of the cable 20.

The sealing portion 133 has an outer peripheral surface having a substantially tapered shape, and is continuous with a rear end of the large outer-diameter portion 132. The outer diameter of the sealing portion 133 is reduced as the sealing portion 133 extends rearward (rearward of the sealing portion 133 in the direction D of fitting the connector 10).

Figure 4:
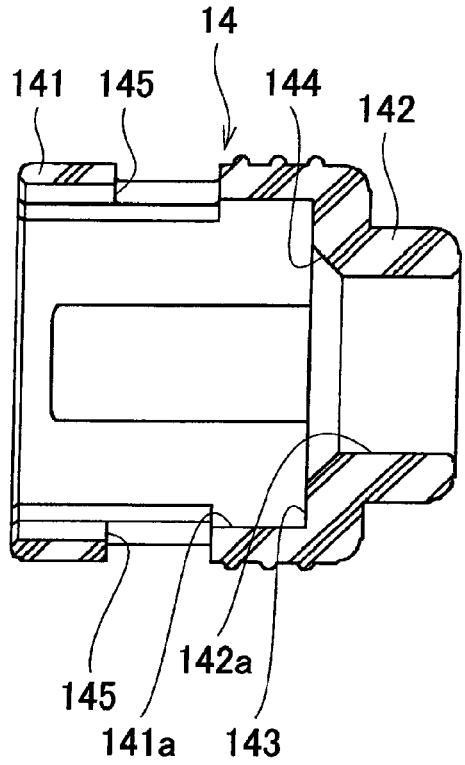
FIG. 4 is a cross-sectional view of an urging member of the connector shown in FIG. 1.

Referring to FIG. 4, the urging member 14 has a substantially hollow cylindrical shape. The urging member 14 includes a housing-receiving portion 141 that accommodates a rear portion of the housing 12, and a cable-inserting portion 142 which is continuous with the housing-receiving portion 141 and into which the cable 20 is inserted. The inner diameter of the housing-receiving portion 141 is larger than that of the cable-inserting portion 142. The cable-inserting portion 142 is located rearward of the housing-receiving portion 141 (rearward in the direction D of fitting the connector 10). A step surface 143 which is parallel to an imaginary surface orthogonal to the central axis of the urging member 14 is formed between an inner peripheral surface 141*a* of the housing-receiving portion 141 and an inner peripheral surface 142*a* of the cable-inserting portion 142. The step surface 143 and the inner peripheral surface 142*a* of the cable-inserting portion 142 are continuous with each other via a tapered surface (urging portion) 144 which is inclined by a predetermined angle with respect to the central axis. The urging member 14 is formed with a pair of locking holes (holes) 145 which communicate between an inner space of the housing-receiving portion 141 and the outside of the housing-receiving portion 141.

Next, a description will be given of how to assemble the connector 10.

First, the cable 20 having the contact 11 connected thereto is inserted through the urging member 14.

Next, the elastic sealing member 13 is received into the elastic sealing member-accommodating portion 121*b* of the housing 12. The outer protruding portions 131*b* of the elastic sealing member 13 are received in the small inner-diameter portion 121*c* of the elastic sealing member-accommodating portion 121*b* of the housing 12, and are brought into close contact with the inner peripheral surface of the through hole 121 of the housing 12.

Thereafter, the contact 11 is received into the contact-accommodating portion 121*a* of the housing 12. When the contact 11 is received into the contact-accommodating portion 121*a*, the lances 112*a* of the contact 11 are hooked on engaging portions (not shown) formed on the inner peripheral surface of the through hole 121 of the housing 12, whereby the contact 11 is held in the contact-accommodating portion 121*a*.

When the contact 11 is inserted into the contact-accommodating portion 121*a*, the cable 20 is inserted through the elastic sealing member 13. However, the other portion than the inner protruding portions 131*a* and 132*b* of the elastic sealing member 13 is not brought into contact with the cable 20, and hence the force required to insert the cable 20 through the elastic sealing member 13 is small.

In a state in which the cable 20 is inserted through the elastic sealing member 13, the inner protruding portions 131*a* and 132*b* are brought into close contact with the cable 20, and further, as mentioned above, the outer protruding portions 131*b* of the elastic sealing member 13 are brought into close contact with the inner peripheral surface of the through hole 121 of the housing 12. This makes it possible to obtain the minimum required waterproof property.

Finally, the urging member 14 fitted on the cable 20 is fitted on the rear portion of the housing 12.

A description will be given of changes in the shape of the elastic sealing member 13 before and after the urging member 14 is fitted on the rear portion of the housing 12 with reference to FIGS. 5 to 7.

Figure 5:
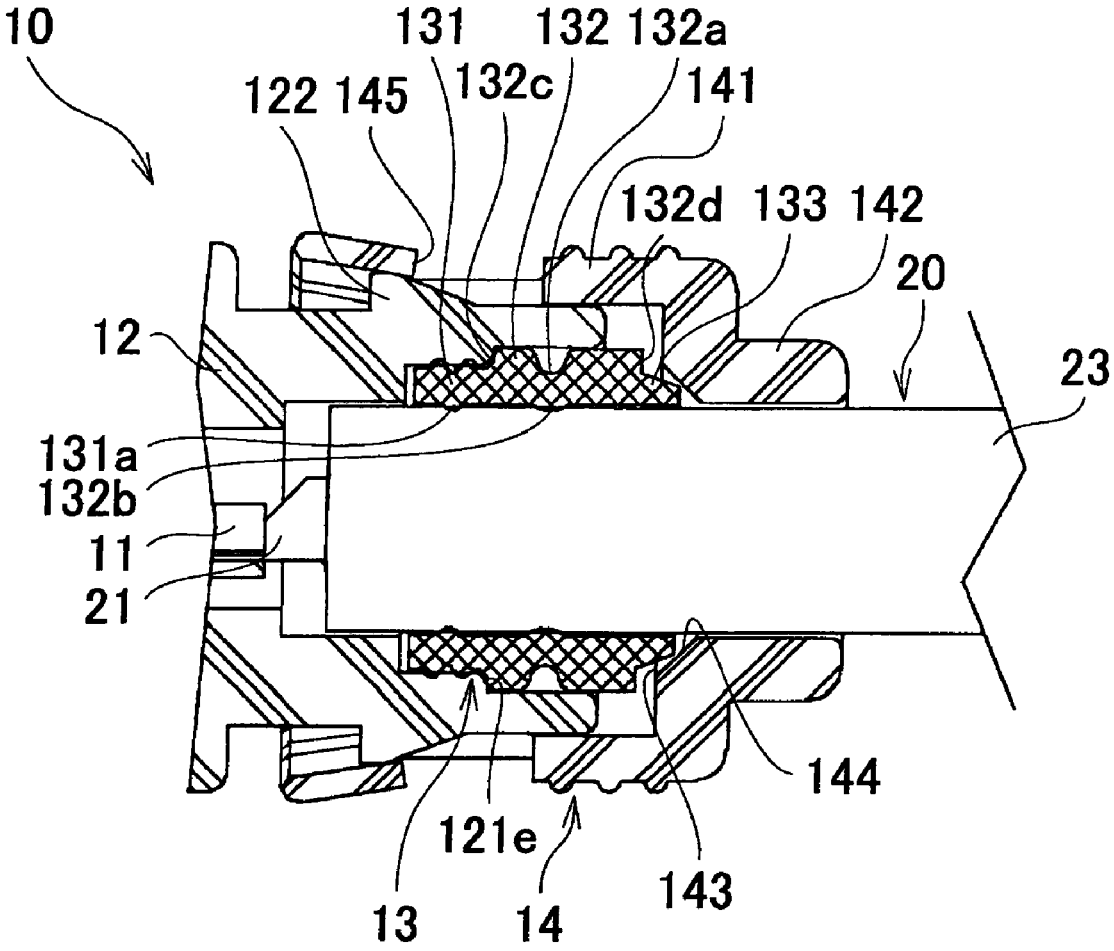
FIG. 5 is a partial cross-sectional view of the connector shown in FIG. 1 in a state before locking lugs of a housing are fitted in respective locking holes of the urging member.

Referring to FIG. 5, first, a front portion of the urging member 14 (front portion in the direction D of fitting the connector 10) pushed toward the housing 12 climbs onto the locking lugs 122.

Figure 6:
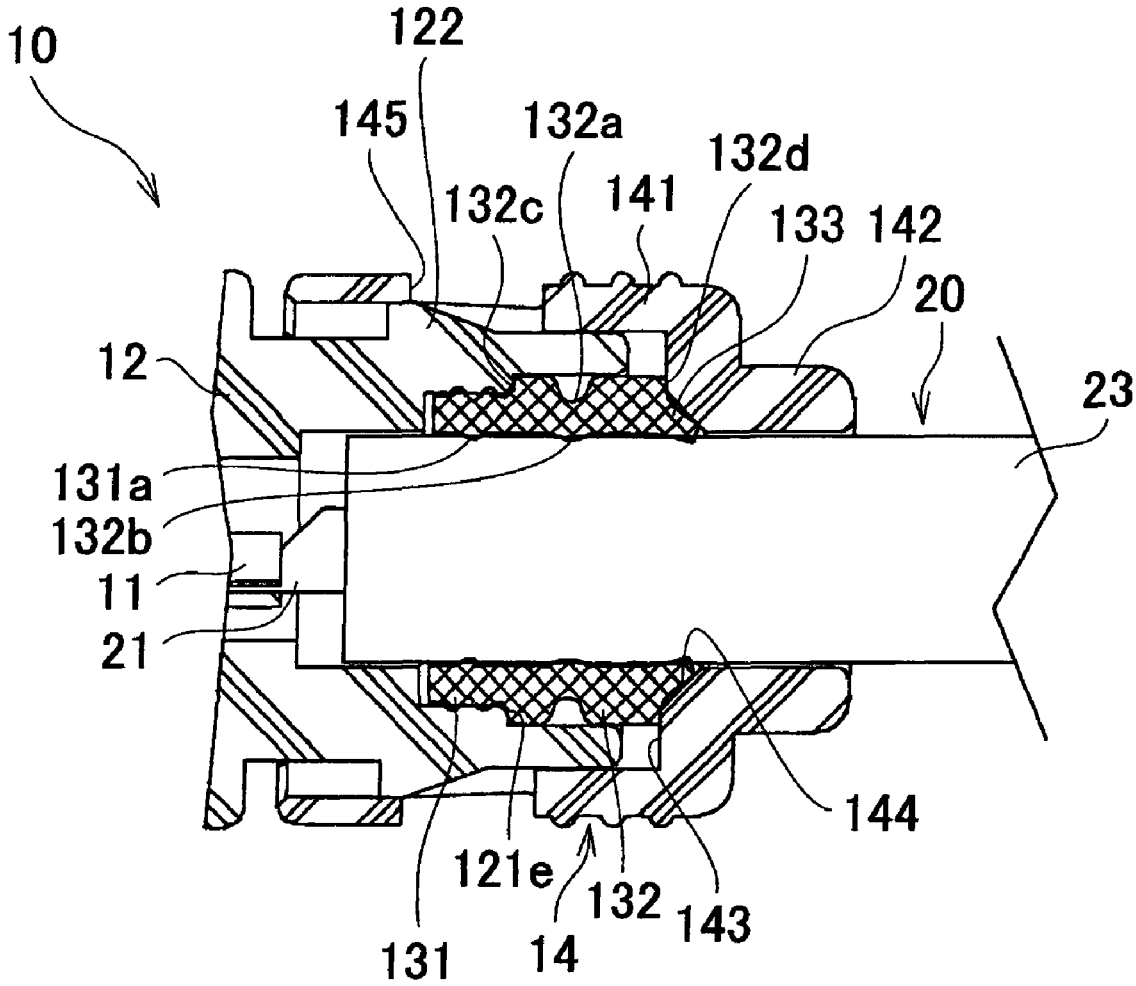
FIG. 6 is a partial cross-sectional view of the connector shown in FIG. 1 in a state immediately before the locking lugs of the housing are fitted in the respective locking holes of the urging member.

Next, as shown in FIG. 6, the sealing portion 133 of the elastic sealing member 13 is urged toward the cable 20 by the tapered surface 144 of the urging member 14. As a result, the sealing portion 133 is brought into close contact with the outer peripheral surface of the cable 20. Further, in substantially the same timing, the step surface 143 of the urging member 14 is brought into abutment with a rear surface 132*d* of the large outer-diameter portion 132 of the elastic sealing member 13.

Figure 7:
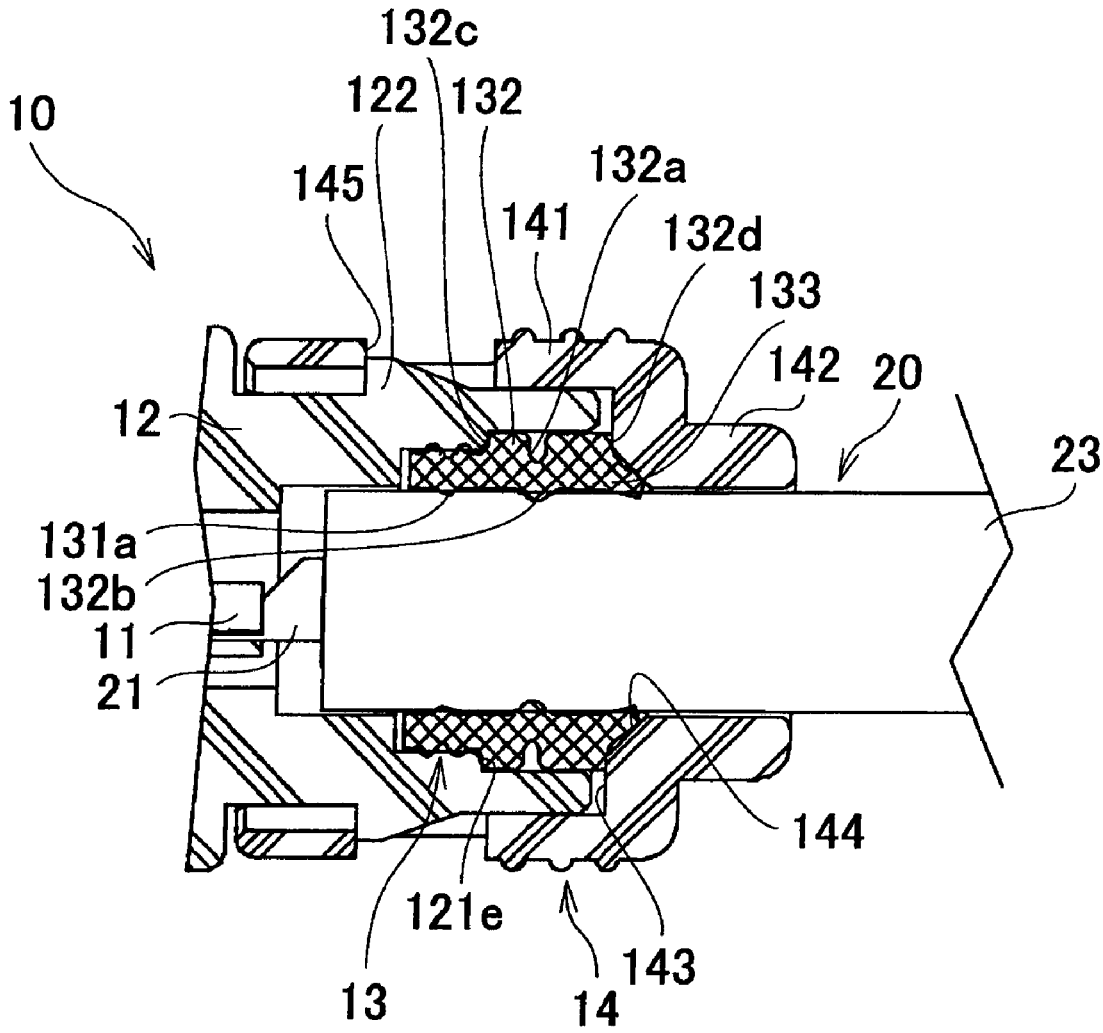
FIG. 7 is a partial cross-sectional view of the connector shown in FIG. 1 in a state in which the locking lugs of the housing are fitted in the respective locking holes of the urging member.

Thereafter, as shown in FIG. 7, the locking lugs 122 of the housing 12 are relatively fitted into the respective locking holes 145 of the urging member 14, whereby the urging member 14 is fixed to the housing 12. At this time, a front surface 132*c* of the large outer-diameter portion 132 of the elastic sealing member 13 is supported by the step surface 121*e* of the through hole 121 of the housing 12, and the rear surface 132*d* of the large outer-diameter portion 132 is urged by the step surface 143 of the urging member 14, and hence the large outer-diameter portion 132 is compressed in the direction of the central axis of the elastic sealing member 13. As a result, the width of the groove 132*a* of the large outer-diameter portion 132 is reduced, and at the same time, the inner protruding portion 132*b* is protuberated toward the central axis of the elastic sealing member 13, whereby the inner diameter of the inner protruding portion 132*b* is reduced, so that the inner protruding portion 132*b* is brought into close contact with the outer peripheral surface of the cable 20.

According to the first embodiment, since only the inner protruding portions 131*a* and 132*b* of the elastic sealing member 13 are brought into contact with the cable 20 before the urging member 14 is fitted on the housing 12, it is possible to insert the cable 20 through the elastic sealing member 13 with a small force. What is more, once the urging member 14 is fitted on the housing 12, the sealing portion 133 is brought into close contact with the cable 20, and hence it is possible to improve the waterproof property of the connector 10.

Further, when the urging member 14 is fitted on the housing 12, the inner protruding portion 132*b* is brought into strong contact with the cable 20, and hence the waterproof property is further improved.

Further, since the inner protruding portion 131*a* is formed on the inner peripheral surface of the small outer-diameter portion 131 of the elastic sealing member 13, and the outer protruding portions 131*b* are formed on the outer peripheral surface of the small outer-diameter portion 131, it is also possible to ensure the waterproof property in the state before the urging member 14 is fitted on the housing 12.

Further, the elastic sealing member 13 includes the small outer-diameter portion 131 and the large outer-diameter portion 132, and the elastic sealing member-accommodating portion 121*b* of the housing 12 includes the small inner-diameter portion 121*c* and the large inner-diameter portion 121*d*. This makes it possible to increase the contact area between the elastic sealing member 13 and the housing 12, whereby it is possible to further improve the waterproof property.

Further, since the housing 12 is formed with the locking lugs 122, and the urging member 14 is formed with the locking holes 145, the engagement of the locking lugs 122 and the locking hole 145 makes it possible to positively fix the urging member 14 to the housing 12, which makes it possible to positively maintain the waterproof state.

Next, a description will be given of a second embodiment of the present invention with reference to FIGS. 8 to 14. Component parts identical to those of the connector according to the first embodiment are designated by identical reference numerals, and detailed description thereof is omitted.

Figure 8:
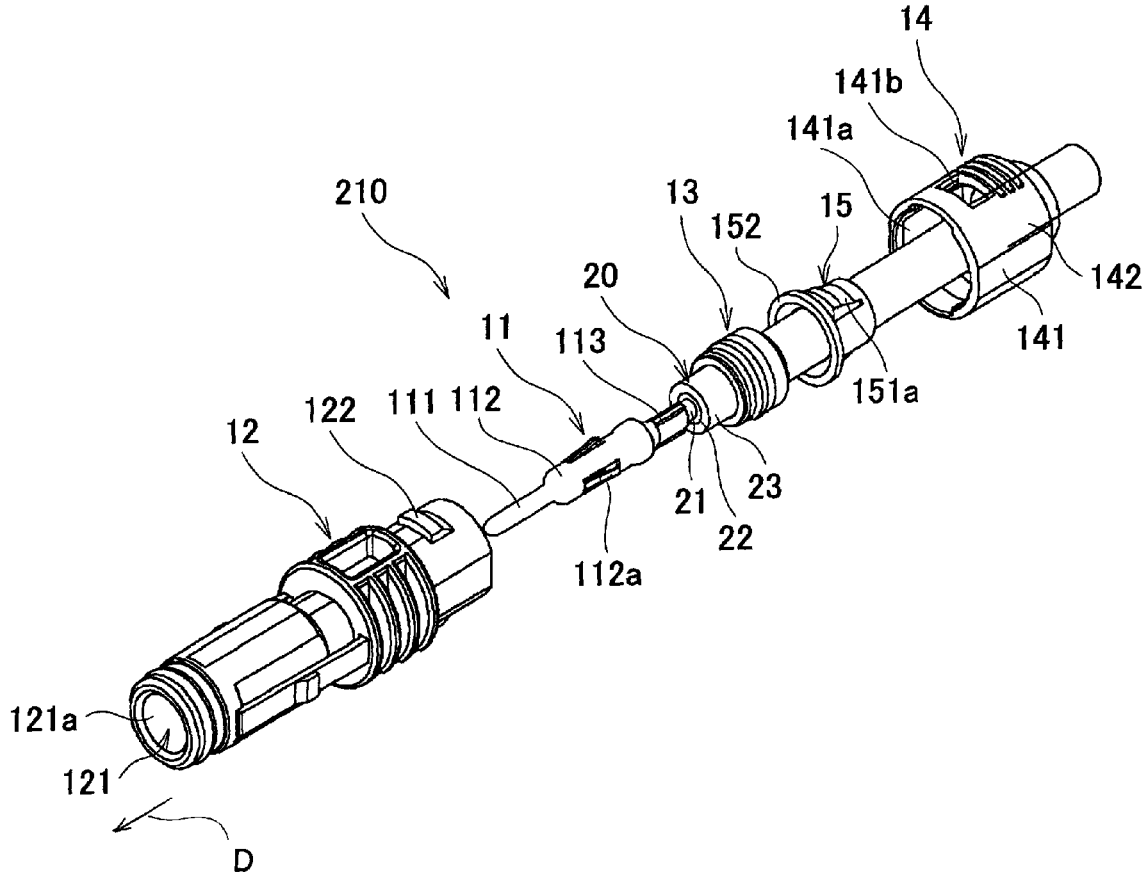
FIG. 8 is an exploded perspective view of a connector according to a second embodiment of the present invention.
Figure 9:
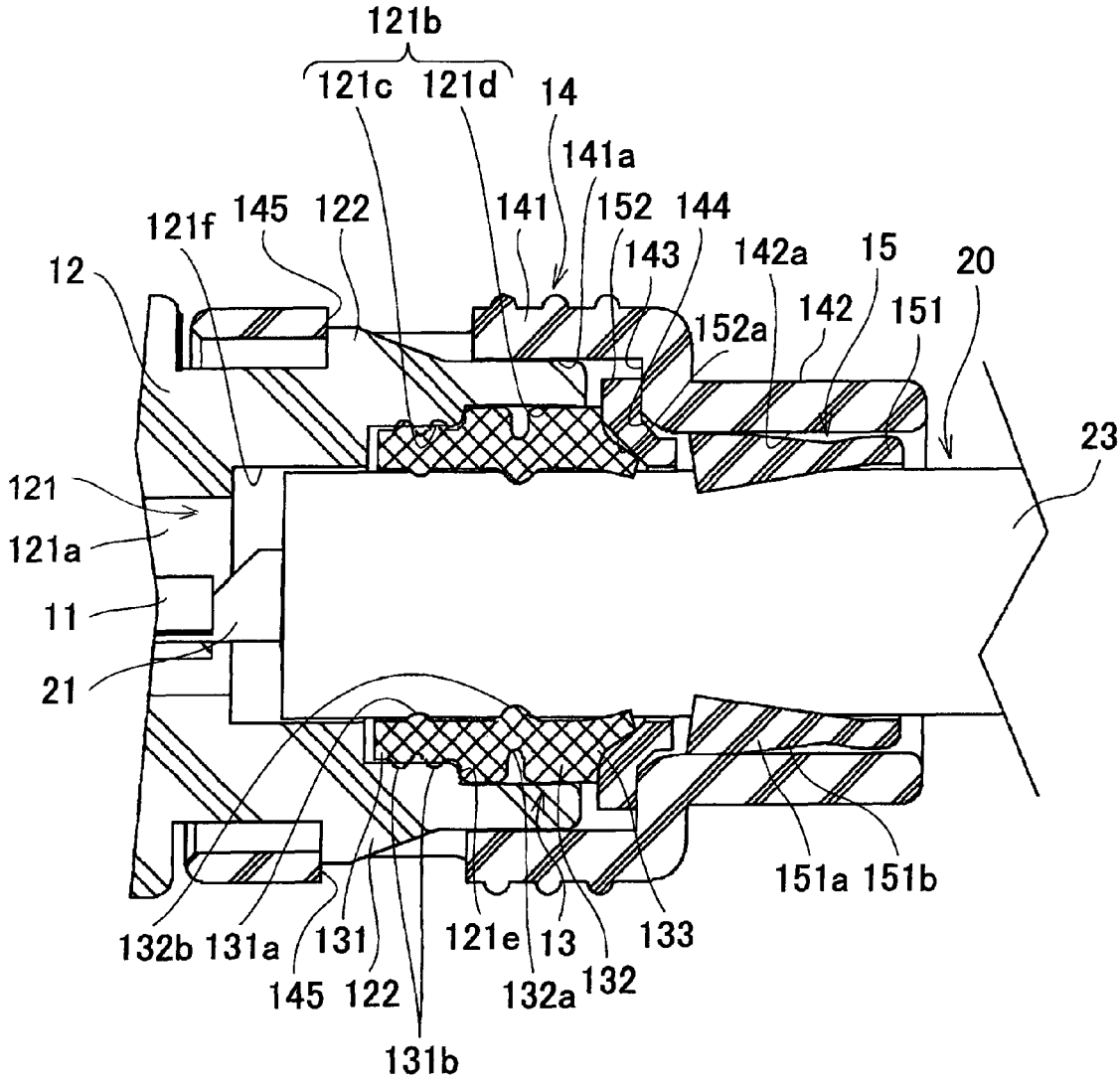
FIG. 9 is a cross-sectional view of a rear portion of the connector shown in FIG. 8.

As shown in FIGS. 8 and 9, in a connector 210 of the second embodiment, a clamp member 15 is interposed between the elastic sealing member 13 and the urging member 14.

Figure 10:
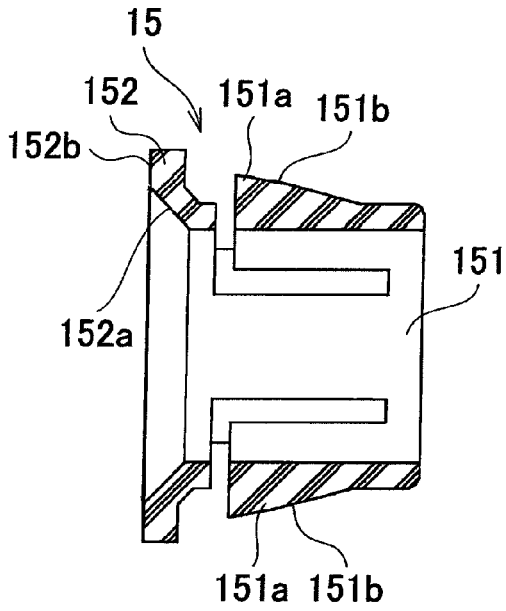
FIG. 10 is a cross-sectional view of a clamp member of the connector shown in FIG. 8.

Referring to FIG. 10, the clamp member 15 includes a hollow cylindrical portion 151 and a flange portion 152. The clamp member 15 is made of a resin. The hollow cylindrical portion 151 is formed with a pair of substantially wedge-shaped flexible portions 151*a*. Each flexible portion 151*a* has an inclined surface 151*b*. The flange portion 152 is continuous with a front portion of the hollow cylindrical portion 151 (front portion in the direction D of fitting the connector 210). The flange portion 152 has an inner periphery formed with a tapered surface (pressing portion) 152*a*.

A description will be given of changes in the respective shapes of the elastic sealing member 13 and the clamp member 15 before and after the urging member 14 is fitted on the rear portion of the housing 12 with reference to FIGS. 11 to 14.

Figure 11:
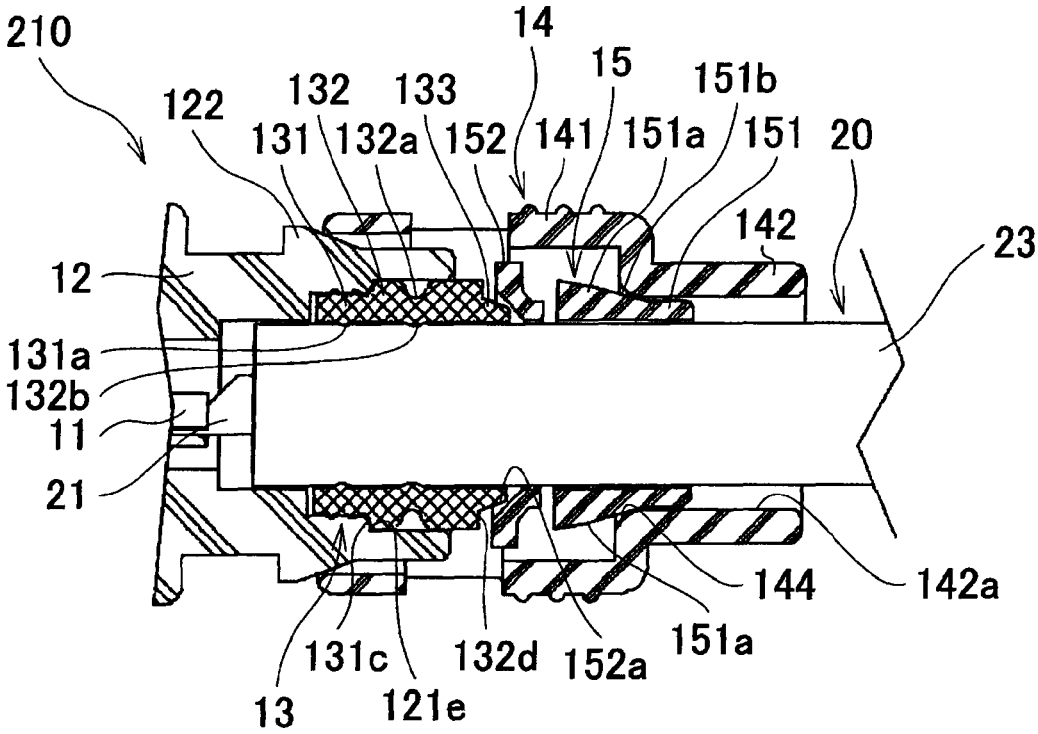
FIG. 11 is a partial cross-sectional view of the connector shown in FIG. 8 in a state before the elastic sealing member is urged by the clamp member.

Referring to FIG. 11, first, the tapered surface 144 of the urging member 14 pushed toward the housing 12 is brought into contact with the flexible portions 151*a* of the clamp member 15.

Figure 12:
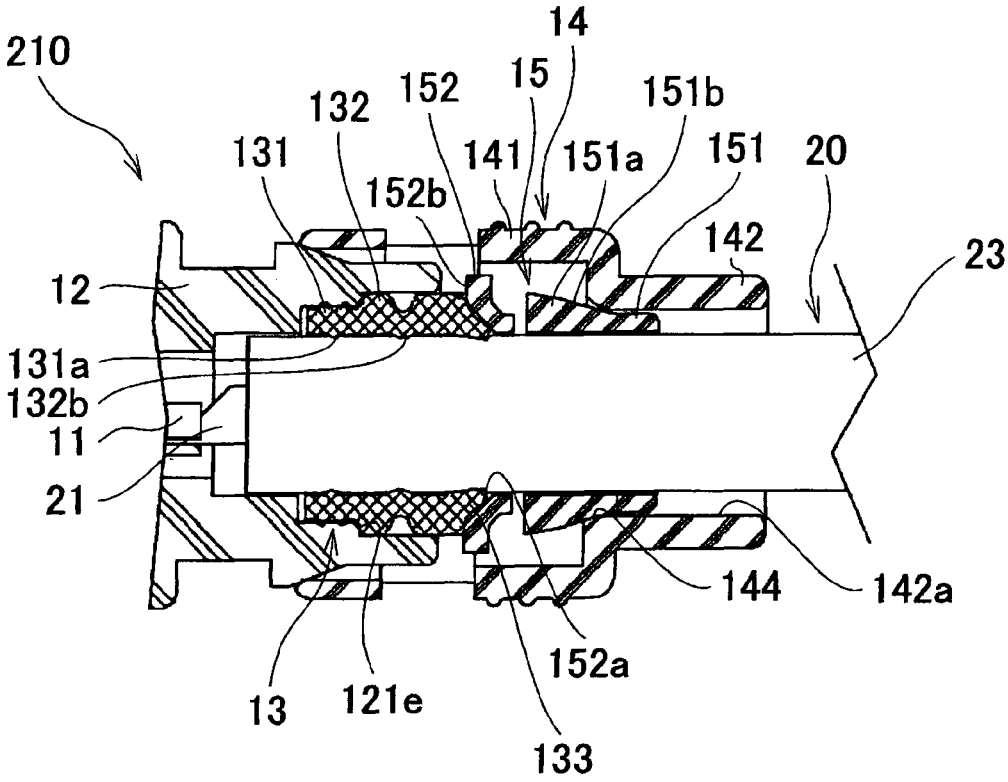
FIG. 12 is a partial cross-sectional view of the connector shown in FIG. 8 in a state in which the elastic sealing member is urged by the clamp member.

Next, as shown in FIG. 12, the urging member 14 presses the inclined surfaces 151*b* of the respective flexible portions 151*a* of the clamp member 15, to thereby move the clamp member 15 toward the elastic sealing member 13, and the tapered surface 152*a* of the flange portion 152 of the clamp member 15 urges the sealing portion 133 of the elastic sealing member 13 toward the cable 20. As a result, the sealing portion 133 is brought into close contact with the cable 20. Further, in substantially the same timing, the front portion of the urging member 14 climbs onto the locking lugs 122 of the housing 12.

Figure 13:
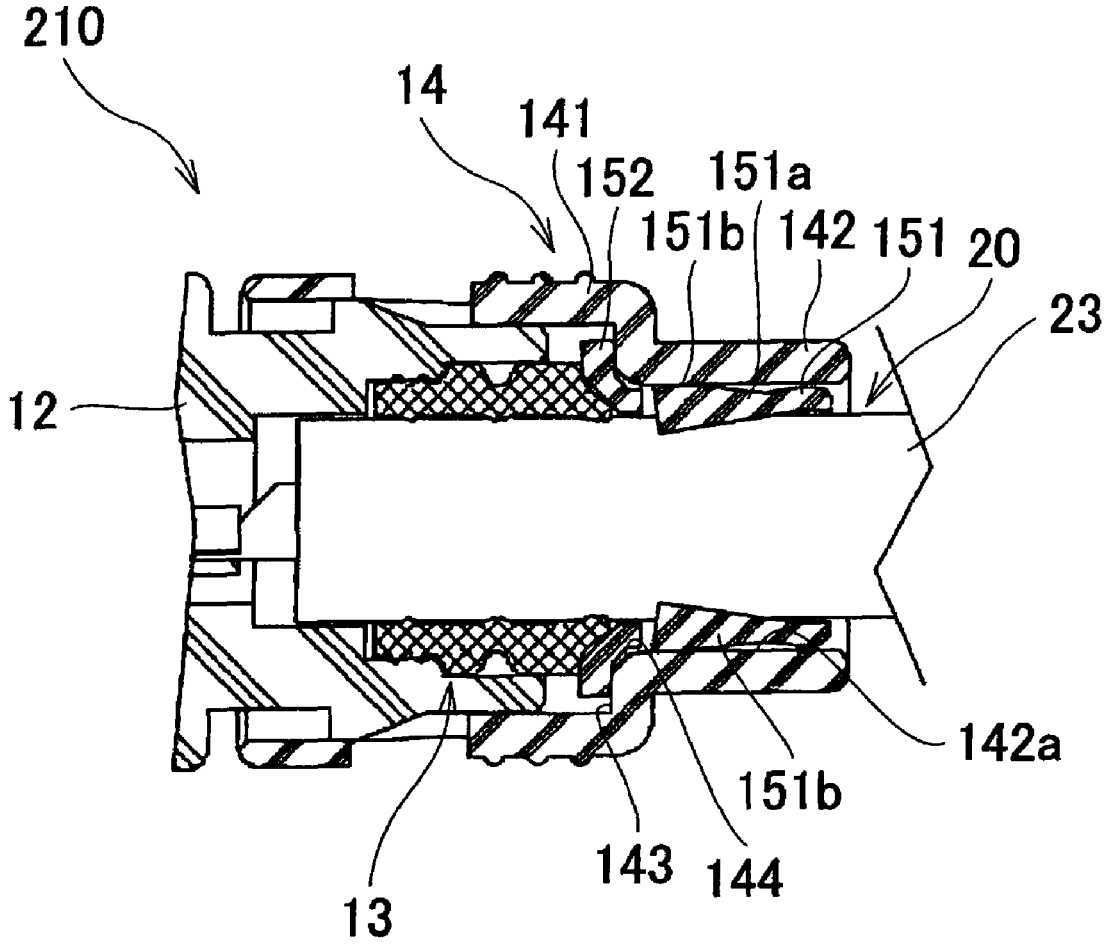
FIG. 13 is a partial cross-sectional view of the connector shown in FIG. 8 in a state in which the clamp member is urged by the urging member.

Thereafter, as shown in FIG. 13, the inner peripheral surface 142*a* of the urging member 14 urges the inclined surfaces 151*b* of the respective flexible portions 151*a* of the clamp member 15, whereby the flexible portions 151*a* each bite into the sheath 23 of the cable 20. At this time, since the inclination angle of each inclined surface 151*b* (inclination of each inclined surface 151*b* with respect to the central axis of the clamp member 15) is small, the force required for urging the urging member 14 toward the housing 12 does not drastically increase, which makes it possible to smoothly operate the urging member 14, whereby the flexible portions 151*a* each gradually bite into the sheath 23.

Figure 14:
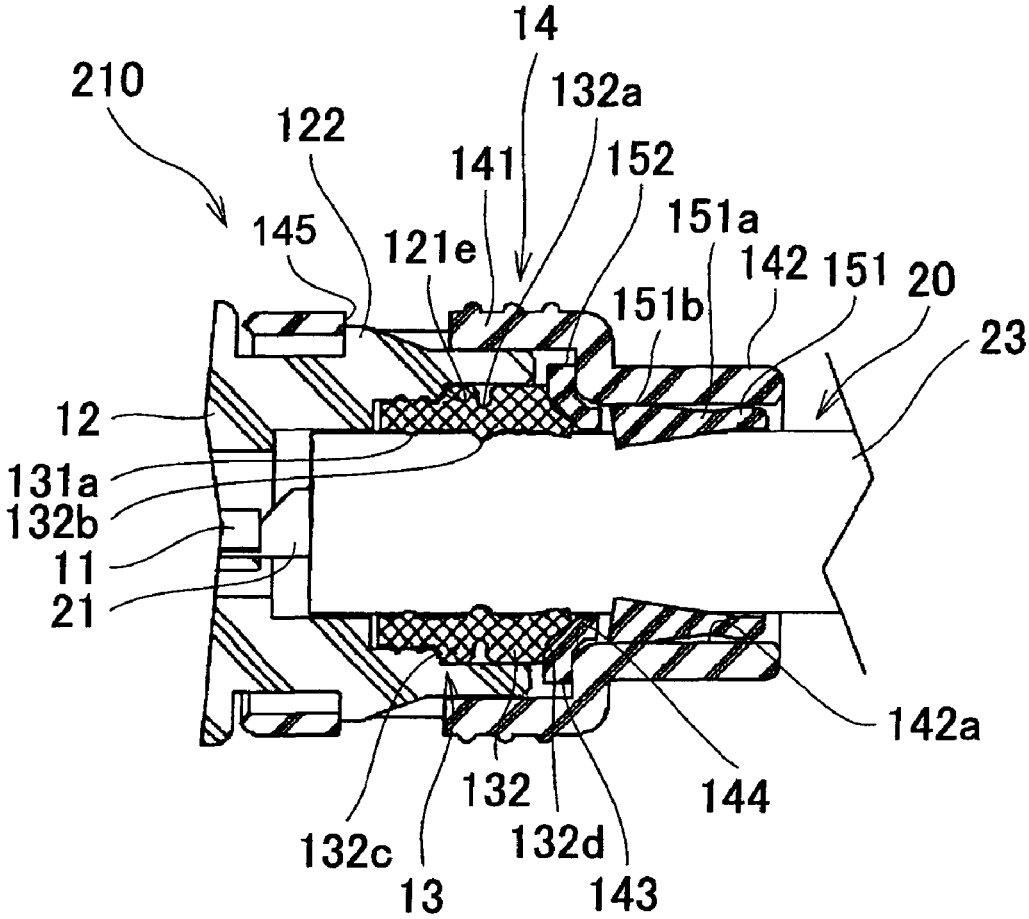
FIG. 14 is a partial cross-sectional view of the connector shown in FIG. 8 in a state in which the locking lugs of the housing are fitted in the respective locking holes of the urging member.

Finally, as shown in FIG. 14, the locking lugs 122 of the housing 12 are relatively fitted into the respective locking holes 145 of the urging member 14, whereby the urging member 14 is fixed to the housing 12. At this time, since the front surface 132*c* of the large outer-diameter portion 132 of the elastic sealing member 13 is supported by the step surface 121*e* of the through hole 121 of the housing 12, and the rear surface 132*d* of the large outer-diameter portion 132 is pressed by the flange portion 152 of the clamp member 15, the large outer-diameter portion 132 is compressed in the direction of the central axis of the elastic sealing member 13. As a result, the width of the groove 132*a* of the large outer-diameter portion 132 is reduced, and at the same time, the inner protruding portion 132*b* is protuberated toward the central axis of the elastic sealing member 13, whereby the inner diameter thereof is reduced, so that the inner protruding portion 132*b* is brought into close contact with the outer peripheral surface of the cable 20.

According to the second embodiment, it is possible to obtain the same advantageous effects as provided by the first embodiment, and since the sheath 23 of the cable 20 is clamped by the flexible portions 151*a* of the clamp member 15, even if the sheath 32 is loosened due to long-term use to become liable to be displaced with respect to the covering 22, it is possible to prevent the sheath 23 from being displaced, which makes it possible to prevent the waterproof property from being lowered.

Figure 15:
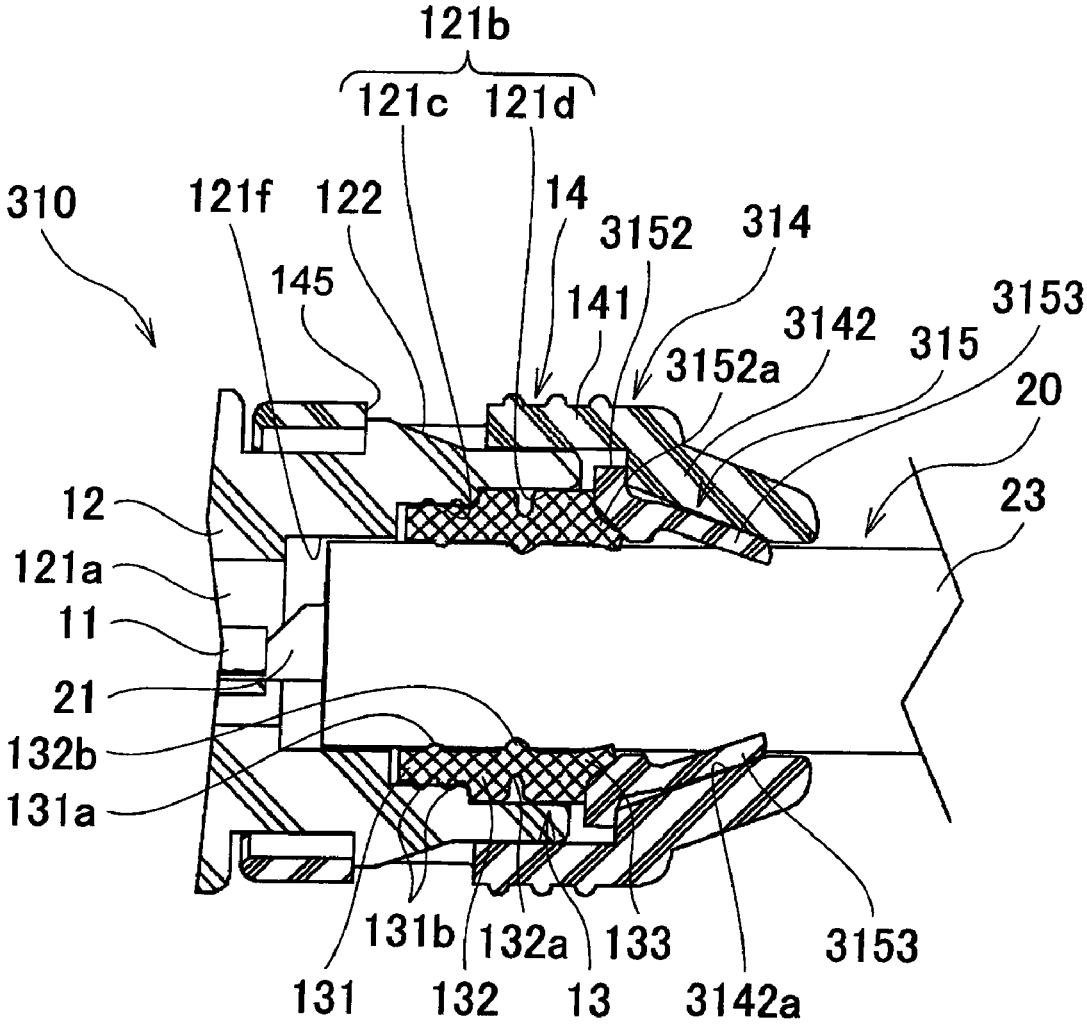
FIG. 15 is a cross-sectional view of a rear portion of a connector according to a third embodiment of the present invention.

Next, a description will be given of a third embodiment of the present invention with reference to FIG. 15. Component parts identical to those of the connector according to the first and second embodiments are designated by identical reference numerals, and detailed description thereof is omitted.

A connector 310 of the third embodiment is distinguished from the connector 210 of the second embodiment in respect of a shape of a pressing member 314 and a shape of a clamp member 315, but identical to the same in the other respects.

The urging member 314 has a cable-inserting portion 3142 formed into a tapered shape.

The clamp member 315 is formed by a flange portion 3152 and a plurality of flexible portions 3153. The flange portion 3152 is formed with a tapered surface (pressing portion) 3152*a*. Each flexible portion 3153 is substantially plate-shaped, and is continuous with a rear portion of the flange portion 3152. The flexible portion 3153 is urged by an inner peripheral surface 3142*a* of the cable-inserting portion 3142 of the urging member 314.

According to the third embodiment, it is possible to obtain the same advantageous effects as provided by the first and second embodiments.

It should be noted that although the elastic sealing member 13 of the above-described embodiments includes the small outer-diameter portion 131, the large outer-diameter portion 132, and the sealing portion 133, it is not necessarily to form the elastic sealing member 13 into such a shape, and may be formed into a simple hollow cylindrical shape, or a hollow prism-like shape.

Further, instead of providing the outer protruding portions 131*b* on the outer peripheral surface of the small outer-diameter portion 131 of the elastic sealing member 13, an inner protruding portion which extends in the circumferential direction may be provided on the inner peripheral surface of the through hole 121 of the housing 12. The inner protruding portion protrudes toward the small inner-diameter portion 121*c*.

Further, a protruding portion which is brought into contact with the elastic sealing member 13 may be provided on the step surface 121*e* of the housing 12 along the circumferential direction.

It is further understood by those skilled in the art that the foregoing are the preferred embodiments of the present invention, and that various changes and modification may be made thereto without departing from the spirit and scope thereof.

What is claimed is:

1. A connector comprising:

a contact that is connected to a cable;

a housing that has a through hole for accommodating said contact that is connected to the cable;

an elastic sealing member that has a hollow cylindrical shape, said elastic sealing member being fitted on an outer peripheral surface of the cable and being accommodated in a rear portion of the through hole; and an urging member that has a hollow cylindrical shape and is fitted on an outer peripheral surface of said housing, said urging member urging said elastic sealing member in an axial direction when said urging member is fitted on the outer peripheral surface of said housing, and said urging member including an urging portion for urging a rear end of said elastic sealing member against the outer peripheral surface of the cable;

wherein the urging portion comprises a tapered surface for urging an outer corner of the elastic sealing member, the outer corner being formed by contact between an outer peripheral surface of the rear end of the elastic sealing member and a rear end surface of the rear end of the elastic sealing member, wherein when the urging portion urges the outer corner of the elastic sealing member, an inner corner of the elastic sealing member, which is formed by contact between an inner peripheral surface of the rear end of the elastic sealing member and the rear end surface of the rear end of the elastic sealing member, is urged against and bites into the outer peripheral surface of the cable.

2. The connector as claimed in claim 1, wherein when said urging member is fitted on the outer peripheral surface of said housing, said urging portion urges said elastic sealing member against an inner peripheral surface of said housing to thereby compress said elastic sealing member in the axial direction.

3. The connector as claimed in claim 2, further comprising:

an outer protruding portion that is formed on an outer peripheral surface of said elastic sealing member such that said outer protruding portion extends along a circumferential direction, and is brought into contact with an inner peripheral surface of the rear portion of the through hole; and an inner protruding portion that is formed on an inner peripheral surface of said elastic sealing member such that said inner protruding portion extends along the circumferential direction, and is brought into contact with the outer peripheral surface of the cable.

4. The connector as claimed in claim 3, wherein said elastic sealing member has a groove formed in the outer peripheral surface thereof such that the groove extends along the circumferential direction, and wherein the groove and said inner protruding portion are arranged substantially at a same location in the axial direction of said elastic sealing member.

5. The connector as claimed in claim 4, wherein the rear portion of the through hole includes a small inner-diameter portion, and a large inner-diameter portion which is located rearward of the small inner-diameter portion and has an inner diameter larger than an inner diameter of the small inner-diameter portion, wherein said elastic sealing member includes a small outer-diameter portion which is accommodated in the small inner-diameter portion, and a large outer-diameter portion which is located rearward of said small outer-diameter portion, and is accommodated in the large inner-diameter portion, said large outer-diameter portion having an outer diameter larger than an outer diameter of said small outer-diameter portion, and wherein said outer protruding portion is located on an outer peripheral surface of said small outer-diameter portion, and said inner protruding portion comprises protruding portions located on an inner peripheral surface of said small outer-diameter portion and an inner peripheral surface of said large outer-diameter portion, respectively, the groove being located in the outer peripheral surface of said large outer-diameter portion.

6. The connector as claimed in claim 1, further comprising:

an outer protruding portion that is formed on an outer peripheral surface of said elastic sealing member such that said outer protruding portion extends along a circumferential direction, and is brought into contact with an inner peripheral surface of the rear portion of the through hole; and an inner protruding portion that is formed on an inner peripheral surface of said elastic sealing member such that said inner protruding portion extends along the circumferential direction, and is brought into contact with the outer peripheral surface of the cable.

7. The connector as claimed in claim 6, wherein said elastic sealing member has a groove formed in the outer peripheral surface thereof such that the groove extends along the circumferential direction, and wherein the groove and said inner protruding portion are arranged substantially at a same location in the axial direction of said elastic sealing member.

8. The connector as claimed in claim 7, wherein the rear portion of the through hole includes a small inner-diameter portion, and a large inner-diameter portion which is located rearward of the small inner-diameter portion and has an inner diameter larger than an inner diameter of the small inner-diameter portion, wherein said elastic sealing member includes a small outer-diameter portion which is accommodated in the small inner-diameter portion, and a large outer-diameter portion which is located rearward of said small outer-diameter portion, and is accommodated in the large inner-diameter portion, said large outer-diameter portion having an outer diameter larger than an outer diameter of said small outer-diameter portion, and wherein said outer protruding portion is located on an outer peripheral surface of said small outer-diameter portion, and said inner protruding portion comprises protruding portions located on an inner peripheral surface of said small outer-diameter portion and an inner peripheral surface of said large outer-diameter portion, respectively, the groove being located in the outer peripheral surface of said large outer-diameter portion.

9. The connector as claimed in claim 1, wherein said urging member has holes formed therein, and said housing has protrusions formed on an outer peripheral surface of a rear end thereof, said protrusions being fitted in the holes, respectively, when said urging member is fitted on the outer peripheral surface of said housing.

10. A connector comprising:

a contact that is connected to a cable;

a housing that has a through hole for accommodating said contact that is connected to the cable;

an elastic sealing member that has a hollow cylindrical shape, said elastic sealing member being fitted on an outer peripheral surface of the cable and being accommodated in a rear portion of the through hole;

an urging member that has a hollow cylindrical shape and is fitted on an outer peripheral surface of said housing; and a clamp member that has a hollow cylindrical shape, and is fitted on the outer peripheral surface of the cable, said clamp member being accommodated in said urging member and clamping said cable when accommodated in said urging member, said clamp member being disposed rearward of said elastic sealing member, and when said urging member is fitted on the outer peripheral surface of said housing, said clamp member being urged by said urging member to urge said elastic sealing member in an axial direction, said clamp member including an urging portion for urging a rear end of said elastic sealing member against the outer peripheral surface of the cable.

11. The connector as claimed in claim 10, wherein when said urging member is fitted on the outer peripheral surface of said housing, said urging portion urges said elastic sealing member against an inner peripheral surface of said housing to thereby compress said elastic sealing member in the axial direction.

12. The connector as claimed in claim 10, wherein said urging member has holes formed therein, and said housing has protrusions formed on an outer peripheral surface of a rear end thereof, said protrusions being fitted in the holes, respectively, when said urging member is fitted on the outer peripheral surface of said housing.

13. A connector comprising:

a contact that is connected to a cable;

a housing that has a through hole for accommodating said contact that is connected to the cable;

an elastic sealing member that has a hollow cylindrical shape, said elastic sealing member being fitted on an outer peripheral surface of the cable and being accommodated in a rear portion of the through hole;

an urging member that has a hollow cylindrical shape and is fitted on an outer peripheral surface of said housing; and a clamp member that has a hollow cylindrical shape, and is fitted on the outer peripheral surface of the cable, said clamp member being accommodated in said urging member, said clamp member being disposed rearward of said elastic sealing member, and when said urging member is fitted on the outer peripheral surface of said housing, said clamp member being urged by said urging member to urge said elastic sealing member in the axial direction, said clamp member including an urging portion for urging a rear end of said elastic sealing member against the outer peripheral surface of the cable, wherein said clamp member includes a plurality of flexible portions which are located rearward of said urging portion in the axial direction, and which are urged against the outer peripheral surface of the cable when said urging member is fitted on the outer peripheral surface of said housing.

14. The connector as claimed in claim 13, wherein when said urging member is fitted on the outer peripheral surface of said housing, said urging portion urges said elastic sealing member against an inner peripheral surface of said housing to thereby compress said elastic sealing member in the axial direction.

15. The connector as claimed in claim 14, further comprising:

an outer protruding portion that is formed on an outer peripheral surface of said elastic sealing member such that said outer protruding portion extends along a circumferential direction, and is brought into contact with an inner peripheral surface of the rear portion of the through hole; and an inner protruding portion that is formed on an inner peripheral surface of said elastic sealing member such that said inner protruding portion extends along the circumferential direction, and is brought into contact with the outer peripheral surface of the cable.

16. The connector as claimed in claim 13, further comprising:

an outer protruding portion that is formed on an outer peripheral surface of said elastic sealing member such that said outer protruding portion extends along a circumferential direction, and is brought into contact with an inner peripheral surface of the rear portion of the through hole; and an inner protruding portion that is formed on an inner peripheral surface of said elastic sealing member such that said inner protruding portion extends along the circumferential direction, and is brought into contact with the outer peripheral surface of the cable.

17. A connector comprising:

a contact that is connected to a cable;

a housing that has a through hole for accommodating said contact that is connected to the cable;

an elastic sealing member that has a hollow cylindrical shape, said elastic sealing member being fitted on an outer peripheral surface of the cable and being accommodated in a rear portion of the through hole;

an urging member that has a hollow cylindrical shape and is fitted on an outer peripheral surface of said housing;

a clamp member that has a hollow cylindrical shape, and is fitted on the outer peripheral surface of the cable, said clamp member being accommodated in said urging member, said clamp member being disposed rearward of said elastic sealing member, and when said urging member is fitted on the outer peripheral surface of said housing, said clamp member being urged by said urging member to urge said elastic sealing member in the axial direction, said clamp member including an urging portion for urging a rear end of said elastic sealing member against the outer peripheral surface of the cable;

an outer protruding portion that is formed on an outer peripheral surface of said elastic sealing member such that said outer protruding portion extends along a circumferential direction, and is brought into contact with an inner peripheral surface of the rear portion of the through hole; and an inner protruding portion that is formed on an inner peripheral surface of said elastic sealing member such that said inner protruding portion extends along the circumferential direction, and is brought into contact with the outer peripheral surface of the cable.

18. The connector as claimed in claim 17, wherein said elastic sealing member has a groove formed in the outer peripheral surface thereof such that the groove extends along the circumferential direction, and wherein the groove and said inner protruding portion are arranged substantially at a same location in the axial direction of said elastic sealing member.

19. The connector as claimed in claim 18, wherein the rear portion of the through hole includes a small inner-diameter portion, and a large inner-diameter portion which is located rearward of the small inner-diameter portion and has an inner diameter larger than an inner diameter of the small inner-diameter portion, wherein said elastic sealing member includes a small outer-diameter portion which is accommodated in the small inner-diameter portion, and a large outer-diameter portion which is located rearward of said small outer-diameter portion, and is accommodated in the large inner-diameter portion, said large outer-diameter portion having an outer diameter larger than an outer diameter of said small outer-diameter portion, and wherein said outer protruding portion is located on an outer peripheral surface of said small outer-diameter portion, and said inner protruding portion comprises protruding portions located on an inner peripheral surface of said small outer-diameter portion and an inner peripheral surface of said large outer-diameter portion, respectively, the groove being located in the outer peripheral surface of said large outer-diameter portion.

20. A connector comprising:

a contact that is connected to a cable;

a housing that has a through hole for accommodating said contact that is connected to the cable;

an elastic sealing member that has a hollow cylindrical shape, said elastic sealing member being fitted on an outer peripheral surface of the cable and being accommodated in a rear portion of the through hole;

an urging member that has a hollow cylindrical shape and is fitted on an outer peripheral surface of said housing;

a clamp member that has a hollow cylindrical shape, and is fitted on the outer peripheral surface of the cable, said clamp member being accommodated in said urging member, said clamp member being disposed rearward of said elastic sealing member, and when said urging member is fitted on the outer peripheral surface of said housing, said clamp member being urged by said urging member to urge said elastic sealing member in the axial direction, said clamp member including an urging portion for urging a rear end of said elastic sealing member against the outer peripheral surface of the cable;

an outer protruding portion that is formed on an outer peripheral surface of said elastic sealing member such that said outer protruding portion extends along a circumferential direction, and is brought into contact with an inner peripheral surface of the rear portion of the through hole; and an inner protruding portion that is formed on an inner peripheral surface of said elastic sealing member such that said inner protruding portion extends along the circumferential direction, and is brought into contact with the outer peripheral surface of the cable.

* * * * *